United States Patent [19]

Klein

[11] 4,069,779

[45] Jan. 24, 1978

[54] BUTTON HOLDER

[76] Inventor: Alice V. Klein, 2535 Homehurst Ave., Pittsburgh, Pa. 15234

[21] Appl. No.: 742,290

[22] Filed: Nov. 15, 1976

[51] Int. Cl.[2] ..... D05B 35/00

[52] U.S. Cl. ..... 112/136; 33/190; 269/287

[58] Field of Search ..... 112/218 R, 136, 77, 112/110, 115, 75, 104, 108, 264, 265; 33/190; 269/2, 287

[56] References Cited

U.S. PATENT DOCUMENTS

| | | | |
|---|---|---|---|
| 289,686 | 12/1883 | Morris | 112/115 |
| 2,350,423 | 6/1944 | Sinning | 269/287 |
| 2,513,633 | 7/1950 | Folsom | 269/2 |
| 2,558,966 | 7/1951 | Lane | 33/190 |
| 3,154,861 | 11/1964 | Rubenstein | 33/190 |

FOREIGN PATENT DOCUMENTS

| | | | |
|---|---|---|---|
| 1,017,450 | 10/1957 | Germany | 112/110 |

*Primary Examiner*—George H. Krizmanich
*Attorney, Agent, or Firm*—William J. Ruano

[57] ABSTRACT

A button holder for holding different sized buttons while underneath a presser foot of a sewing machine to assure a firm hold and accurate placement of the hole relative to the needle to prevent breakage of the latter.

The holder comprises essentially a strip of material having a plurality of different sized holes for accommodating the particular button sizes. Slits are provided at both ends of the strip extending from the outermost holes to allow movement of the threaded needle and avoid the necessity of cutting the thread after sewing on the button, permitting the sewing of another button.

2 Claims, 3 Drawing Figures

BUTTON HOLDER

This invention relates to a button holder for holding buttons of selective sizes underneath a presser foot of a sewing machine for sewing buttons on, by machine, to a garment.

An outstanding disadvantage of sewing buttons by sewing machine, in the past, has been the great difficulty, particularly for smaller buttons, of holding the button stationary while sewing it to a garment. Buttons tend to be easily moved out of place, thereby causing needle breakage if the button hole is missed by the sewing machine needle. Also, the button tends to turn about its axis which aggrevates the problem. Therefore, sewing of buttons by a sewing machine, to do a professional job of button sewing, has been abandoned because of the difficulties involved and resort has been made to the more tedious, time consuming and much less professional job of hand sewing of buttons. Sometimes buttons are held in place by basting, but the seamstress may as well sew them by hand which is the next step.

An object of my invention is to provide a novel button holder which overcomes the above-named disadvantages and which will assure a firm hold of the button in a fixed position while moving the cloth under a presser foot for sewing on the button.

Another object of the invention is to provide an exceedingly simple inexpensive and easy to operate strip with cut-outs serving as wells for receiving different size buttons.

A further object and advantage of the present invention, is to provide means in the aforesaid strip which enables it to be easily slipped underneath the sewing needles of the sewing machine without the necessity of stopping the machine.

Other objects and advantages of the invention will become more apparent from a study of the following description, taken with the accompanying drawing wherein.

Figure 1:
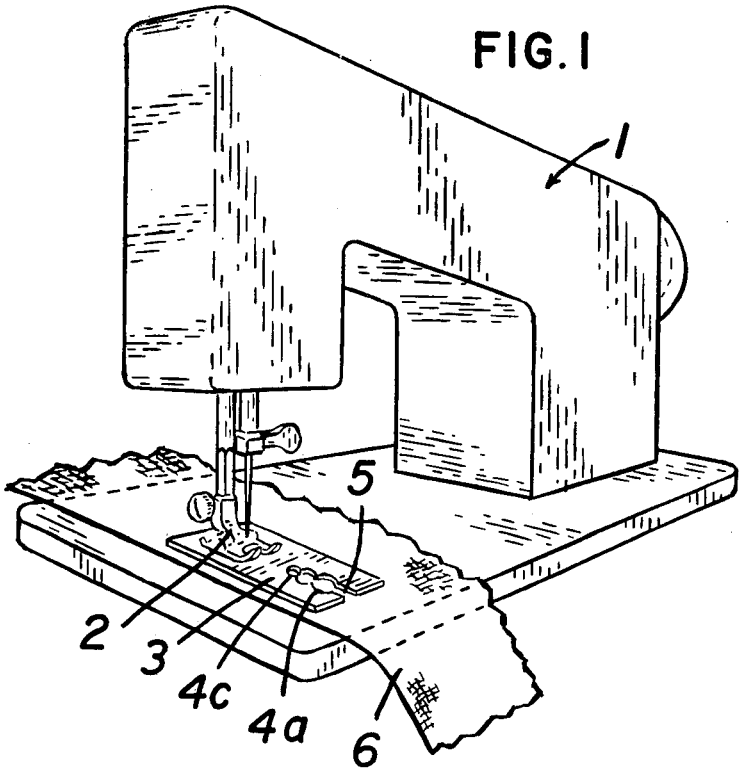
FIG. 1 is a perspective view of a sewing machine including a presser foot underneath which a button holding strip is shown, embodying the present invention.

Referring more particularly to FIG. 1 of the drawing, numeral 1 generally denotes a sewing machine of ordinary construction which includes a presser foot 2, underneath which cloth, onto which buttons are to be sewn, is fed.

Figure 2:
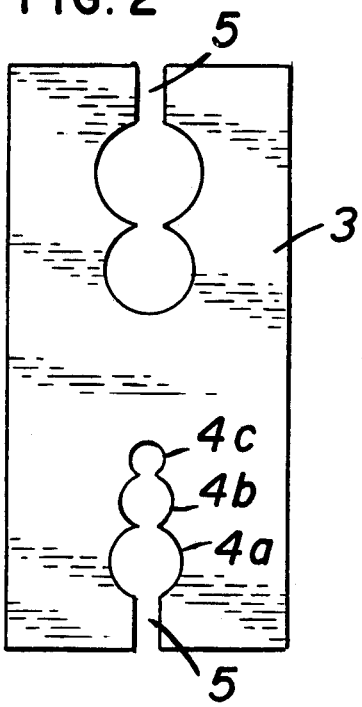
FIG. 2 is an enlarged plan view of the button holding strip shown in FIG. 1.
Figure 3:
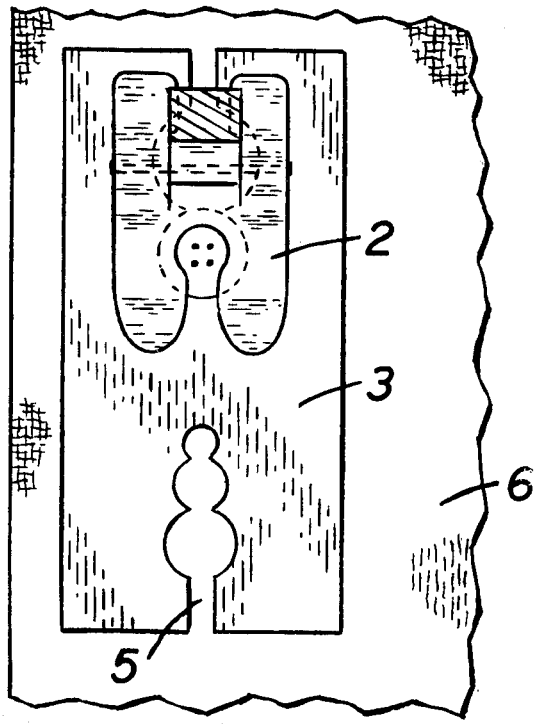
FIG. 3 is a similar view with other parts.

As shown in FIG. 2, numeral 3 denotes a button holder embodying the present invention comprising a plurality of selected sizes of holes, *4a, 4b, 4c* etc. which serves as wells for receiving buttons of the desired size to be sewn. The button holder may be made of any suitable material, such as cardboard, cloth, plastic, metal foil etc., and may be about 4 to 6 inches long, about 2 inches wide, and about 1/6th inch in thickness to firmly hold the button so that it may be slipped easily under the presser foot of the sewing machine and on top of cloth 6 (FIG. 3).

The holes in the button holder should be of the same size as buttons that are standard on the market, such as ¾ inch, ⅝ inch, ⅜ inch, ¼ inch and very small buttons less than ¼ inch. Buttons larger than an inch are easily held by the finger. The standard presser foot for a zig-zag stitch is wider than the diameter of small buttons.

Grooves 5,5 are provided centrally at the ends of the strip for the easy removal of the holder from the now attached button, without the necessity of cutting the thread of the sewing machine needle and so as to be ready for the sewing of the next button and other buttons, if desired.

The button holder of the present invention holds the button precisely in the desired position and keeps it from slipping around so that the hole in the button will be in line with the action of the zig-zag stitch or the like. The width between the holes differ slightly and will allow the streamstress to adjust the width of the stitch. The button holder prevents the button from being shattered or the needle from breaking. It saves time and exasperation of the seamstress.

The step-by-step operation in the use of the button holder of the present invention is as follows:

Mark the garment where the buttons are to be placed; select the same size hole of the button holder as that of the button; place the marked spot directly in the center of the hole in the holder; line up the holes in the button to accomodate the action of the back and forth stitch of the sewing machine, or sideway stitch; slip the button into the hole of the button holder, with holes of the button, correctly lined up; make any necessary adjustment as to the width of the holes in the button; (the button holder acts as a "third hand" and holds the button firmly in place); drop the presser foot down on the button holder and button, and sew; after the button is attached, lift the holder up over the button, and pull the threads through the opening above the holder, and go on to the next button.

While round holes have been shown in the holder, these could be square, octagonal, oval or other shapes to accomodate the particular button to be sewn.

Thus it will be seen that I have provided a highly efficient, inexpensive and simple to use button holder for securely holding a button in a desired position and to keep the button from slipping around so that the holes in the button will be in line with the zig-zag stitch. The distance between the holes differs slightly and will allow the seamstress to adjust the width of the stitch. The button holder prevents the button from being shattered or the needle from breaking and saves considerable time and exasperation of the seamstress.

While I have illustrated and described a single specific embodiment of my invention, it will be understood that this is by way of illustration only and that various changes and modifications may be contemplated in my invention and within the scope of the following claims.

I claim:

1. A button holder for use in a sewing machine having a vertically reciprocable needle and presser foot, a button holder comprising a strip of flexible sheet material having at least one cut-out portion conforming to the shape of a button to be held thereby and of slightly larger diameter, while the strip is fed underneath the presser foot and on top of the garment to which the button is to be sewed by said machine, and a slit extending from the end of said cut-out portion and being open from the cut-out to the end edge of the strip for allowing removal of the strip after sewing of the button onto said garment without cutting the thread.

2. Apparatus as recited in claim 1 wherein said button holder has a plurality of circular cut-out portions of different sizes and open to each other and to the edge for receiving different sized buttons and wherein a slit is provided substantially centrally of the strip and extending from each end of the outmost cut-out portions.

* * * * *